US009272859B2

(12) United States Patent
Sato

(10) Patent No.: US 9,272,859 B2
(45) Date of Patent: Mar. 1, 2016

(54) SUPPLY APPARATUS, METHOD FOR SUPPLYING PRINT MEDIUM, AND PRINTING APPARATUS

(71) Applicant: CANON KABUSHIKI KAISHA, Tokyo (JP)

(72) Inventor: Noriko Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/558,844

(22) Filed: Dec. 3, 2014

(65) Prior Publication Data

US 2015/0166275 A1 Jun. 18, 2015

(30) Foreign Application Priority Data

Dec. 17, 2013 (JP) ..... 2013-260503

(51) Int. Cl.
*B65H 3/06* (2006.01)
*B65H 7/06* (2006.01)

(52) U.S. Cl.
CPC ..... *B65H 3/0669* (2013.01); *B65H 3/0684* (2013.01); *B65H 7/06* (2013.01); *B65H 2301/423245* (2013.01); *B65H 2404/1521* (2013.01); *Y10T 74/18528* (2015.01)

(58) Field of Classification Search
CPC ..... B65H 3/0684; B65H 3/0676; B65H 2402/31; B65H 2404/152; B65H 2404/1521; B65H 2301/423245
USPC ..... 271/9.02–9.04, 9.12
See application file for complete search history.

(56) References Cited

U.S. PATENT DOCUMENTS

| | | | | |
|---|---|---|---|---|
| 7,600,745 | B2 * | 10/2009 | Asada | 271/9.08 |
| 7,614,621 | B2 * | 11/2009 | Asada | 271/117 |
| 7,722,030 | B2 * | 5/2010 | Sugiyama et al. | 271/117 |
| 8,027,607 | B2 | 9/2011 | Kurata et al. | |
| 8,326,169 | B2 | 12/2012 | Kurata et al. | |
| 8,626,051 | B2 | 1/2014 | Kasuga et al. | |
| 8,695,961 | B2 * | 4/2014 | Uchida | 271/9.11 |
| 8,807,556 | B2 | 8/2014 | Sugiyama et al. | |
| 2003/0102622 | A1 * | 6/2003 | Johnson et al. | 271/25 |
| 2003/0227124 | A1 * | 12/2003 | Yun | 271/10.11 |
| 2004/0046309 | A1 * | 3/2004 | Lee et al. | 271/121 |
| 2004/0141785 | A1 * | 7/2004 | Kang | 400/578 |
| 2005/0029732 | A1 * | 2/2005 | Chang | 271/113 |
| 2007/0145670 | A1 * | 6/2007 | Asada | 271/117 |
| 2007/0248365 | A1 * | 10/2007 | Gettelfinger et al. | 399/16 |
| 2013/0001856 | A1 * | 1/2013 | Uchida | 271/9.11 |

FOREIGN PATENT DOCUMENTS

JP 2002-046874 A 2/2002

* cited by examiner

*Primary Examiner* — Patrick Cicchino
(74) *Attorney, Agent, or Firm* — Fitzpatrick, Cella, Harper & Scinto

(57) ABSTRACT

A supply apparatus including: a supply member that contacts a print medium and feeds out the print medium; a drive transmission unit configured to transmit rotation of a drive shaft to the supply member; and an arm member that supports the supply member and the drive transmission unit and rotates around a predetermined axis, wherein a contacting position between the supply member and the print medium is switched to any position of an upstream side or a downstream side in the feeding-out direction depending on a rotating position of the arm member.

23 Claims, 6 Drawing Sheets

SUPPLY APPARATUS, METHOD FOR SUPPLYING PRINT MEDIUM, AND PRINTING APPARATUS

BACKGROUND OF THE INVENTION

1. Field of the Invention

The present invention relates to a supply apparatus, a method for supplying print mediums and a printing apparatus, and, in particular, to a supply apparatus that appropriately supplies print mediums.

2. Description of the Related Art

It is well known that a printing apparatus that performs a print on a print medium is provided with a supply apparatus that separates loaded print mediums one by one and supplies the separated print medium to a printing location. The supply apparatus is provided with a feeding unit that uses a swing arm method in which a roller is supported on a front end of an arm rotating around a predetermined axis, and a separating unit that has a separation inclined surface at a predetermined angle to the loaded print medium.

As this type of supply apparatuses, Japanese Patent Laid-Open No. 2002-46874 discloses a supply apparatus that is provided with two arms having different lengths to each other in a feeding-out direction of a print medium, and rotation of a drive shaft is transmitted to anyone of two rollers supported respectively on the two arms depending on a rotating direction of the drive shaft. In this supply apparatus, the two rollers are arranged in different positions in a direction (width direction of the print medium) crossing the feeding-out direction.

In the supply apparatus disclosed in Japanese Patent Laid-Open No. 2002-46874, the rotation of the drive shaft is transmitted to the roller arranged in the downstream side in the feeding-out direction to rotate the roller, which prevents thin sheets from being fed out in a stacking state. In addition, the rotation of the drive shaft is transmitted to the roller arranged in the upstream side in the feeding-out direction to rotate the roller, which makes the print medium easily bent to prevent a thick sheet from being not fed out.

In the supply apparatus disclosed in Japanese Patent Laid-Open No. 2002-46874, the roller rotated by transmission of the rotation of the drive shaft, as well as the roller to which the rotation of the drive shaft is not transmitted contact the print medium. Therefore a local load is applied on an area of the print medium, the area being interposed between two positions where the rollers contact. As a result, there is a case where creases or breaks are accrued on this area of the print medium.

SUMMARY OF THE INVENTION

The present invention provides a supply apparatus, a method for supplying print mediums and a printing apparatus, which are able to appropriately supply print mediums without applying a local load on the print medium.

According to a first aspect of the present invention, there is provided a supply apparatus including:

a supply member that contacts a print medium and feeds out the print medium;

a drive transmission unit configured to transmit rotation of a drive shaft to the supply member; and an arm member that supports the supply member and the drive transmission unit and rotates around a predetermined axis, wherein a contacting position between the supply member and the print medium is switched to any position of an upstream side or a downstream side in the feeding-out direction depending on a rotating position of the arm member.

According to a second aspect of the present invention, there is provided a method for supplying a print medium in a supply apparatus including a supply member that contacts a print medium and feeds out the print medium, a drive transmission unit configured to transmit rotation of a drive shaft to the supply member, and an arm member that supports the supply member and the drive transmission unit and rotates around a predetermined axis, including the step of:

switching a contacting position between the supply member and the print medium to any position of the upstream side or the downstream side in the feeding-out direction depending upon a kind of the print medium.

According to a third aspect of the present invention, there is provided a supply apparatus including:

a supply member that contacts a print medium and feeds out the print medium;

a support member that supports the supply member;

a separation inclined surface that applies a resistance on a front end of the print medium fed out by the supply member; and a distance changing unit configured to change a distance from the separation inclined surface to a position where the supply member contacts the print medium.

According to the above configuration, the supply member is made to contact the print medium in any position of the upstream side or the downstream side in the feeding-out direction to feed out the print medium. Therefore the print medium can be appropriately supplied without applying a local load on the print medium.

Further features of the present invention will become apparent from the following description of exemplary embodiments (with reference to the attached drawings).

DESCRIPTION OF THE EMBODIMENTS

Hereinafter, embodiments of the present invention will be in detail explained with reference to the accompanying drawings.

First Embodiment

Figure 1:
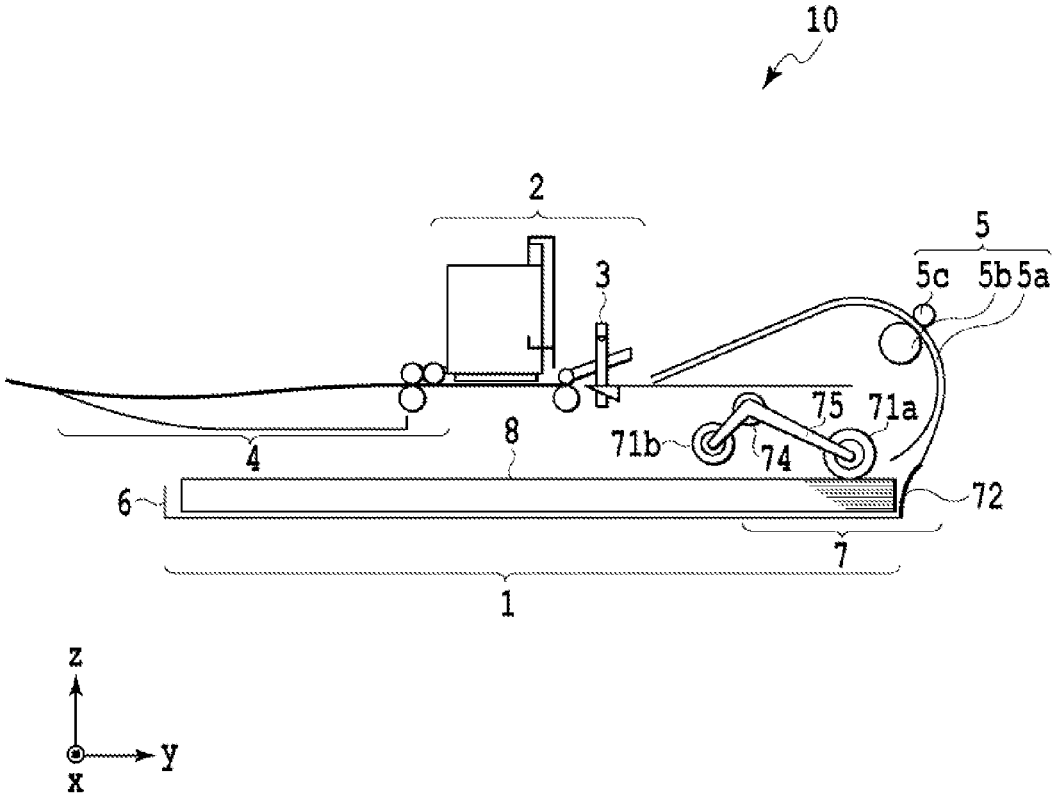
FIG. 1 is a sectional diagram showing a printing apparatus provided with a supply apparatus.

FIG. 1 is a sectional diagram showing a printing apparatus 10 provided with a supply apparatus 1 in the present embodiment. As shown in this figure, the printing apparatus 10 includes the supply apparatus 1, a printing unit 2, a detecting unit 3, a discharging unit 4, and a conveying unit 5. As shown in this figure, the supply apparatus 1 is disposed in a lower side in the printing apparatus 10 (−z direction in this figure).

The supply apparatus 1 includes a loading unit 6, a feeding unit 7, and a separation unit (separation inclined surface) 72. The loading unit 6 accommodates stacked print mediums. The feeding unit 7 includes a drive shaft 74, an arm (arm member) 75, and a supply roller 71*a* and a supply roller 71*b* that are supply members. The separation inclined surface 72 is disposed at an angle to a front end of the loaded print medium at the downstream side in the y direction in a position at the downstream side in the feeding-out direction (y direction) of the print medium. The details of the configuration of the supply apparatus 1 will be described later with reference to FIGS. 2A to 2C.

The drive shaft 74 is driven forward and backward by a shaft drive unit (not shown). In the present embodiment, this shaft drive unit acts as a position switching unit (distance changing unit) 70 that will be described later with reference to FIG. 3. The arm 75 is swingably supported to the drive shaft 74, and the supply rollers 71*a* and 71*b* are rotatably supported respectively at both ends of the arm 75. In the present embodiment, any of the supply roller 71*a* and the supply roller 71*b* rotates while contacting the print medium 8 positioned in the uppermost part (+x direction in this figure) in the loading unit 6, and thereby a conveying force is applied to the print medium 8, which will be fed out to the downstream side in the y direction.

In the supply apparatus 1, the feeding unit 7 is used to feed out the print mediums 8 loaded on the loading unit 6, and the print mediums 8 are separated one by one by the separation inclined surface 72, and each is then supplied. The supplied print medium 8 is conveyed by the conveying unit 5. The conveying unit 5 includes a conveying path 5*a*, a conveying roller 5*b*, and a pinch roller 5*c*. The print medium 8 is interposed between the conveying roller 5*b* and the pinch roller 5*c*, and is conveyed along the conveying path 5*a* by rotation of these rollers.

The conveyed print medium 8 is detected by the detecting unit 3. When the print medium 8 is detected by the detecting unit 3, the print medium 8 is further conveyed toward the printing unit 2. In addition, a printing process such as printing of an image is executed onto the print medium 8, and the processed print medium 8 is placed on the discharging unit 4.

In the supply apparatus 1, the print medium advances toward the separation inclined surface 72, and the front end of the print medium 8 strikes on the separation inclined surface 72. Then the print medium 8 advances in a state where the front end of the print medium 8 is being bent by reaction from the separation inclined surface 72. A print medium subsequent to this print medium 8 is subjected to a frictional force from a print medium present right under the subsequent print medium, and therefore is prevented from advancing together with this print medium 8 to be supplied. In this way, the supply apparatus 1 separates the loaded print mediums one by one and feeds out the separated print medium.

In this configuration, the separation between the print mediums is performed by a balance between a force (feeding-out force) for feeding out the print medium by the supply roller and a resistance force of the separation inclined surface to the front end of the print medium. Therefore for example, in a case where the kind of the print medium differs, such as a thin sheet or a thick sheet, in a case where a state of the print medium changes by environmental conditions, or in a case where the conveying force of the supply roller changes or the like, the print medium is appropriately supplied by responding to a change in balance between the feeding-out force and the resistance force.

For example, at the time of supplying thin sheets, weakening the feeding-out force to the print medium or strengthening the resistance force of the separation inclined surface prevents two or more thin sheets from being fed out to be stacked (stack feeding). At the time of supplying thick sheets, strengthening the feeding-out force to the print medium or weakening the resistance force of the separation inclined surface prevents the thick sheet from being not fed out (non-feeding). Hereinafter, an explanation will be made by roughly classifying the kind of the print medium into two kinds of thin sheet and thick sheet.

Figure 2A:
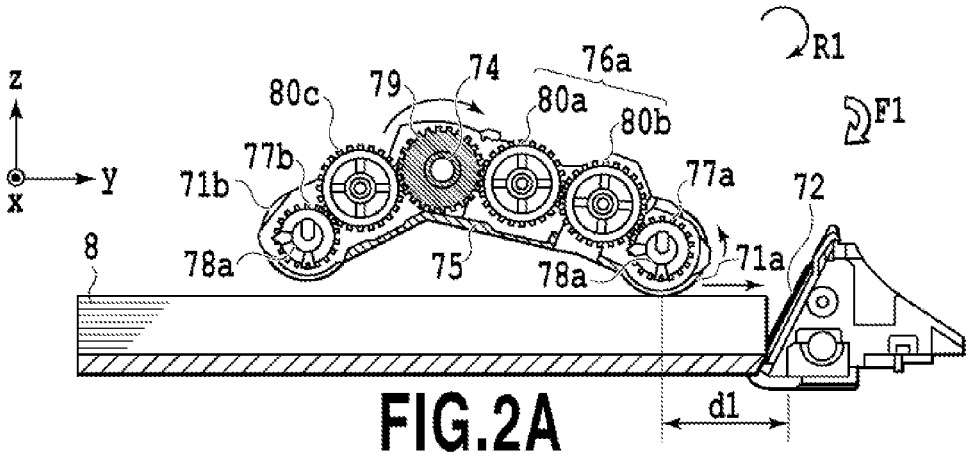
FIG. 2A is a diagram showing a supply apparatus according to a first embodiment.
Figure 2B:
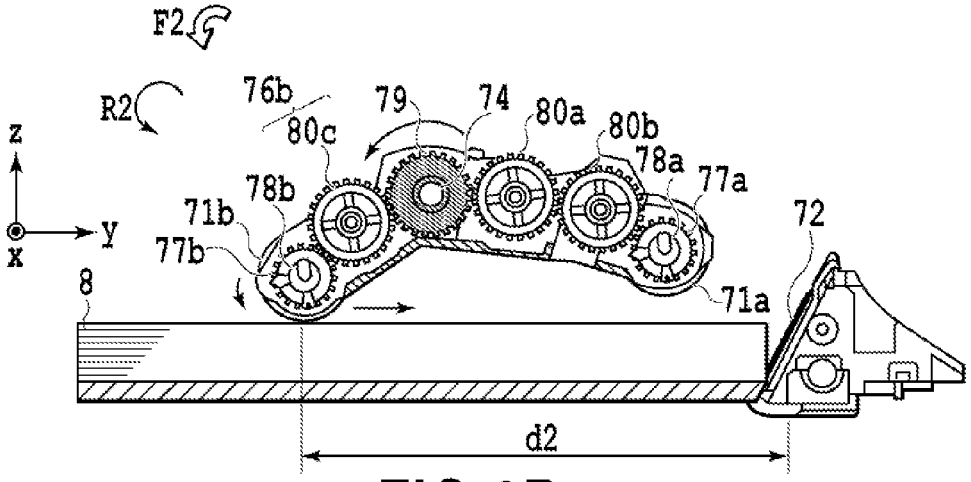
FIG. 2B is a diagram showing the supply apparatus according to the first embodiment.
Figure 2C:
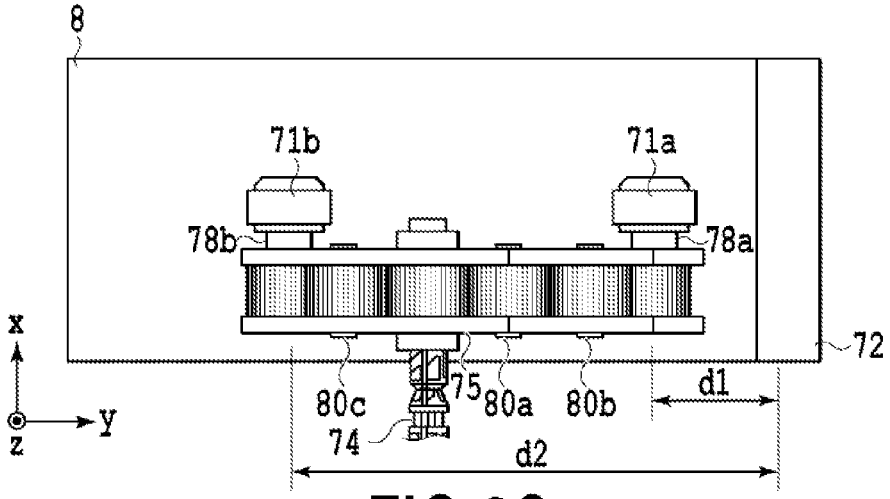
FIG. 2C is a diagram showing the supply apparatus according to the first embodiment.

FIG. 2A to FIG. 2C are diagrams each showing the supply apparatus 1 in the present embodiment. FIG. 2A is a sectional diagram showing the supply apparatus 1 in a first supply position, FIG. 2B is a sectional diagram showing the supply apparatus 1 in a second supply position, and FIG. 2C is a top diagram showing the supply apparatus 1 as viewed in a +z direction.

As shown in FIG. 2A to FIG. 2C, in the present embodiment, a first drive transmission unit 76*a* is provided between the drive shaft 74 and the supply roller 71*a*, and a second drive transmission unit 76*b* is provided between the drive shaft 74 and the supply roller 71*b*. The supply roller 71*a* is arranged in the downstream side in the y direction and the supply roller 71*b* is arranged in the upstream side in the y direction.

The first drive transmission unit 76*a* includes idler gears 80*a*, 80*b*, and the second drive transmission unit 76*b* includes an idler gear 80*c*. The idler gears 80*a*, 80*b* transmit rotation of a drive gear 79 rotated with rotation of the drive shaft 74 to a supply roller gear 77*a*. The supply roller gear 77*a* is fixed to an end of a supply shaft 78*a* which is different from an end thereof to which the supply roller 71*a* is fixed. The supply shaft 78*a* rotates with rotation of the supply roller gear 77*a*, and the supply roller 71*a* fixed to the supply shaft 78*a* rotates therewith.

The idler gear 80*c* transmits rotation of the drive gear 79 rotated with rotation of the drive shaft 74 to a supply roller gear 77*b*. The supply roller gear 77*b* is fixed to an end of a supply shaft 78*b* which is different from an end thereof to which the supply roller 71*b* is fixed. The supply shaft 78*a* rotates with rotation of the supply roller gear 77*b*, and the supply roller 71*b* fixed to the supply shaft 78*a* rotates therewith.

As shown in FIG. 2A, when the drive shaft 74 rotates in a clockwise direction (R1 direction) from a front view in the figure, force F1 in the R1 direction is added to the arm 75. Thereby the arm 75 rotates in the R1 direction to cause the supply roller 71*a* to contact the print medium 8. In this case, the print medium 8 is fed out in the downstream side in the y direction by rotation of the supply roller 71*a*. Here, a rotating position of the arm 75 shown in FIG. 2A is called a first rotating position, and a position where the supply roller 71*a* contacts the print medium 8 is called a first contacting position. In this way, a position where the supply roller contacts the print medium in the downstream side in the y direction to feed out the print medium is called a first supply position.

As shown in FIG. 2B, when the drive shaft 74 rotates in a counterclockwise direction (R2 direction) from a front view in the figure, force F2 in the R2 direction is added to the arm 75. Thereby the arm 75 rotates in the R2 direction to cause the supply roller 71*b* to contact the print medium 8. In this case, the print medium 8 is fed out in the downstream side in the y direction by rotation of the supply roller 71*b*. Here, a rotating position of the arm 75 shown in FIG. 2B is called a second rotating position, and a position where the supply roller 71*b* contacts the print medium 8 is called a second contacting position. In this way, a position where the supply roller contacts the print medium in the upstream side in the y direction to feed out the print medium is called a second supply position.

In the present embodiment, the contacting position between the roller and the print medium 8 is switched to any position of the upstream side or the downstream side in the y direction depending on the rotating position of the arm 75. Specifically the shaft drive unit that acts as the position switching unit 70 rotates the drive shaft 74 in the R1 direction or R2 direction in response to an instruction from the control unit 9 to be described later by referring to FIG. 3. The arm 75 rotates with rotation of the drive shaft 74 to be arranged to the first rotating position or the second rotating position. Thereby the supply roller 71*a* or the supply roller 71*b* contacts the print medium 8 in the first contacting position or the second contacting position.

As shown in FIG. 2A to FIG. 2C, a distance d2 from the supply roller 71*b* to the separation inclined surface 72 is longer than a distance d1 from the supply roller 71*a* to the separation inclined surface 72. In the present embodiment, the supply roller 71*a* is designed to contact the print medium 8 in a position where the distance to the separation inclined surface 72 is relatively near to feed out the print medium 8, thereby increasing the resistance force that the front end of the print medium 8 receives from the separation inclined surface 72 to be relatively large. As a result, for example, the sheet stack feeding can be prevented at the time of supplying thin sheets.

In addition, the supply roller 71*b* is designed to contact the print medium 8 in a position where the distance to the separation inclined surface 72 is relatively far to feed out the print medium 8, thereby decreasing the resistance force that the front end of the print medium 8 receives from the separation inclined surface 72 to be relatively small. As a result, for example, the non-sheet feeding can be prevented at the time of supplying thick sheets.

As shown in FIG. 2A and FIG. 2B, in the present embodiment, in a case where the drive shaft 74 rotates in the R1 direction and the supply roller 71*a* contacts the print medium 8, the arm 75 separates the supply roller 71*b* from the print medium 8. On the other hand, in a case where the drive shaft 74 rotates in the R2 direction and the supply roller 71*b* contacts the print medium 8, the arm 75 separates the supply roller 71*a* from the print medium 8.

When the arm 75 is configured in this manner, both of the supply rollers 71*a*, 71*b* are designed not to contact the print medium 8 together, which therefore does not generate an area of the print medium 8 interposed between the contacting positions of the two rollers. In the present embodiment, this configuration can prevent creases or breaks of the print medium.

In addition, as shown in FIG. 2C, in the present embodiment, the supply roller 71*a* and the supply roller 71*b* are arranged in the same position in the x direction crossing the feeding-out direction (y direction) of the print medium 8. Therefore even in a case where any of the supply rollers is used, a right-left imbalanced conveying resistance of the print medium 8 in the width (x direction) direction is not generated. Therefore it is possible to prevent generation of oblique movement of the print medium 8.

For example, also in a case of disposing a separation member on a part of the separation inclined surface 72, since a position relation of the supply roller and the separation member in the X direction is the same even if any of the supply rollers is used, the print medium 8 can be stably supplied with no generation of the oblique movement of the print medium 8.

Further, as shown in FIG. 2C, the supply roller 71*a* and the supply roller 71*b* are arranged in the central part of the supply apparatus 1 in the x direction. Accordingly in the printing apparatus in which the printing to print mediums having different sizes is possible, the supply roller can be positioned to contact on the central part of the print medium having any size to feed out the print medium. Therefore it is possible to prevent the oblique movement of the print medium regardless of the size of the print medium.

As described above, in the present embodiment, by changing the rotating direction of the drive shaft 74, it is possible to switch use of the supply roller 71*a* positioned in the downstream side in the feeding-out direction and the supply roller 71*b* positioned in the upstream side in the feeding-out direction therein for supplying the print medium 8. As a result, the contacting position between the supply roller and the print medium can be selectively switched in a simple configuration without adopting the complicated configuration.

It should be noted that each of the first drive transmission unit and the second drive transmission unit is not limited to the configuration shown in the present embodiment. In the present embodiment, the explanation is made of the configuration that the first drive transmission unit is provided with the idler gears 80*a*, 80*b*, and the second drive transmission unit is provided with the idler gear 80*c*. However, if the first drive transmission unit is provided with an even number of idler gears and the second drive transmission unit is provided with an odd number of idler gears, the effect similar to that of the present embodiment can be achieved.

Figure 3:
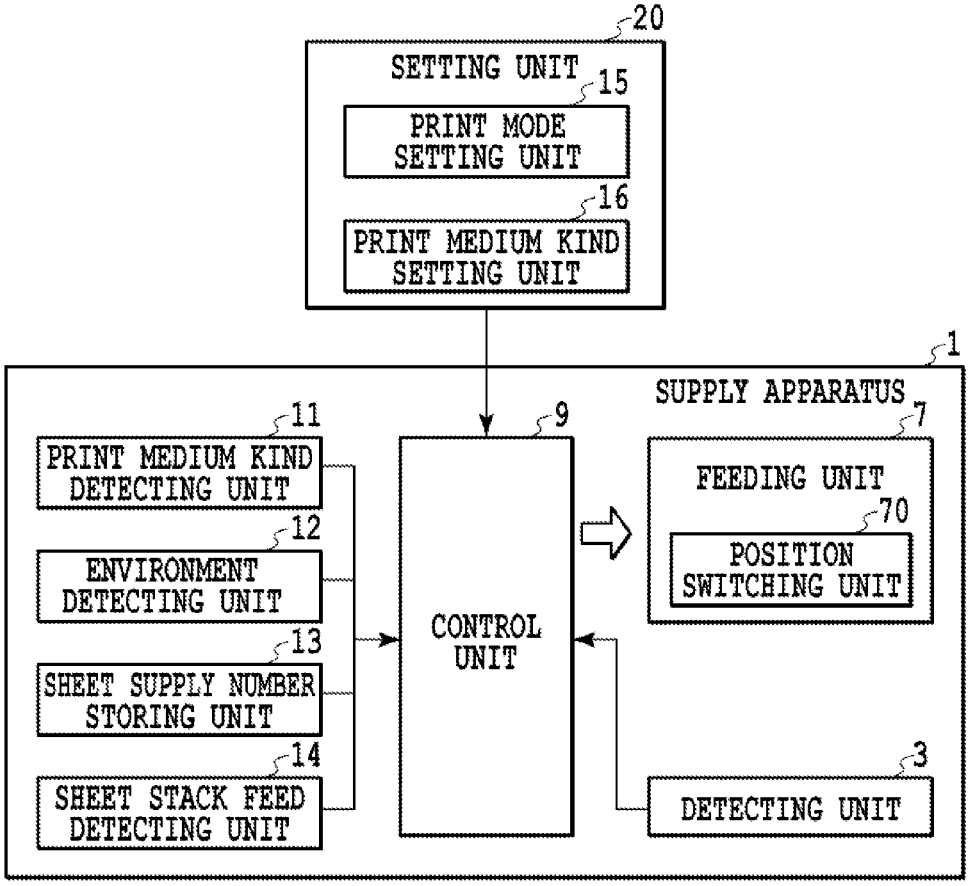
FIG. 3 is a block diagram showing the control configuration of the supply apparatus.

FIG. 3 is a block diagram showing the control configuration of the supply apparatus 1. As shown in this figure, the supply apparatus 1 is connected to a setting unit 20 in the printing apparatus 10. It should be noted that in the present embodiment, an explanation will be made of a case where the supply apparatus 1 is connected to the setting unit 20 in the printing apparatus 10, but the supply apparatus 1 may be connected to various kinds of setting units of an external device such as a host computer.

As shown in FIG. 3, the supply apparatus 1 includes the feeding unit 7, the detecting unit 3, the control unit 9, a print medium kind detecting unit 11, an environment detecting unit 12, a sheet supply number storing unit 13 and a sheet stack feed detecting unit 14. The feeding unit 7 includes the position switching unit 70 and supplies print mediums. The detecting unit 3 detects the print medium 8 advancing toward the printing unit 2. The control unit 9 controls each part of the supply apparatus 1.

The print medium kind detecting unit 11 detects the kind of the print medium 8. The environment detecting unit 12 detects temperature, humidity and the like in the supply apparatus 1. As a result, it is possible to predict a change in hardness of the print medium due to an influence of the environment condition in the supply apparatus 1 or the like. The sheet supply number storing unit 13 detects the sheet number of the print mediums supplied from the supply apparatus 1. The sheet stack feed detecting unit 14 detects that two or more print mediums 8 are supplied over the separation inclined surface 72 to detect the feeding-out situation of the print medium. The detection result of the detecting unit 3, the print medium kind detecting unit 11, the environment detecting unit 12, the sheet supply number storing unit 13, and sheet stack feed detecting unit 14 is transmitted to the control unit 9 as needed.

In addition, as shown in FIG. 3, the setting unit 20 in the printing apparatus 10 is provided with a print mode setting unit 15 and a print medium kind setting unit 16. In the print mode setting unit 15, a print mode to be executed to the print medium is set, and in the print medium kind setting unit 16, the kind of the print medium to be printed on is set. The setting result of the print mode setting unit 15 and the print medium kind setting unit 16 is transmitted to the control unit 9 as needed.

The control unit 9 transmits a switching command to the position switching unit 70 in the feeding unit 7 based upon the obtained detection result or setting result. In the present embodiment, the shaft drive unit acting as the position switching unit 70 rotates the drive shaft 74 in the rotating direction in response to a switching command. It should be noted that the control unit 9 may transmit the switching command in response to an instruction from a user.

In a case where the detection result of the print medium kind detecting unit 11 or the setting result of the print medium kind setting unit 16 indicates a thin sheet, in a case where the detection result of the environment detecting unit 12 indicates high temperature and high humidity that weaken hardness of the print medium, in a case where the sheet stack feeding is detected by the sheet stack feed detecting unit 14, or the like, the contacting position is switched to the first contacting position. That is, the drive shaft 74 is rotated in the R1 direction to rotate the arm 75 in the R1 direction, and the supply roller 71*a* in a position relatively close to the separation inclined surface 72 is used to feed out the print medium. By doing so, the resistance force that the front end of the print medium receives from the separation inclined surface 72 can be made relatively strong to appropriately supply the print medium.

In a case where the setting result of the print mode setting unit 15 indicates a photo print mode where a print is performed to a photo sheet as a thick sheet, for example, when it is predicted that the sheet number stored in the sheet supply number storing unit 13 increases to lower the conveying force of the supply roller, the contacting position is switched to the second contacting position. That is, the drive shaft 74 is rotated in the R2 direction to rotate the arm 75 in the R2 direction, and the supply roller 71*b* in a position relatively far from the separation inclined surface 72 is used to feed out the print medium. By doing so, the resistance force that the front end of the print medium receives from the separation inclined surface 72 can be made relatively weak to appropriately supply the print medium.

In addition, in a case where a time from a point where rotation of the supply roller starts to a point where the print medium is detected by the detecting unit 3 is shorter than a predetermined time, it is determined that there is a high possibility that the sheet stack feeding is generated, and the contacting position is switched to the first contacting position. That is, the drive shaft 74 is rotated in the R1 direction to rotate the arm 75 in the R1 direction, and the supply roller 71*a* is used to feed out the print medium.

On the other hand, in a case where the time from a point where rotation of the supply roller starts to a point where the print medium is detected by the detecting unit 3 is longer than the predetermined time, it is determined that there is a high possibility that the non-sheet feeding is generated, and the contacting position is switched to the second contacting position. That is, the drive shaft 74 is rotated in the R2 direction to rotate the arm 75 in the R2 direction, and the supply roller 71*b* is used to feed out the print medium.

In a case where the print medium is not detected by the detecting unit 3 even after the predetermined time elapses from a point where rotation of the supply roller starts, the contacting position may be switched to the second contacting position to continue the supply operation. Therefore the contacting position is switched regardless of the detection result or setting result from the other detecting unit to prevent the print mediums from being supplied to be stacked or the print medium from being not supplied, thus appropriately supplying the print medium. In this way, the contacting position can be changed in accordance with the time from a point where the supply of the print medium starts to a point where the print medium reaches the supply destination.

As described above, in the present embodiment, the contacting position of the supply roller to the print medium is switched based upon the detection result or setting information, thus making it possible to appropriately supply the print medium.

Second Embodiment

In the present embodiment, one end of an arm is rotatably supported on a drive shaft, and a supply roller is rotatably supported on an end of the arm that is different from the one end of the arm supported by the drive shaft. A drive transmission unit is provided with one idler gear, and the arm is provided with a spring. In the present embodiment, there is provided a lock member as a regulation member that is engaged to the spring to limit the movement of the arm.

In the present embodiment, the lock member and the spring member are used to switch the contacting position. The other configuration is the same as that of the first embodiment, and therefore the explanation will be omitted.

Figure 4A:
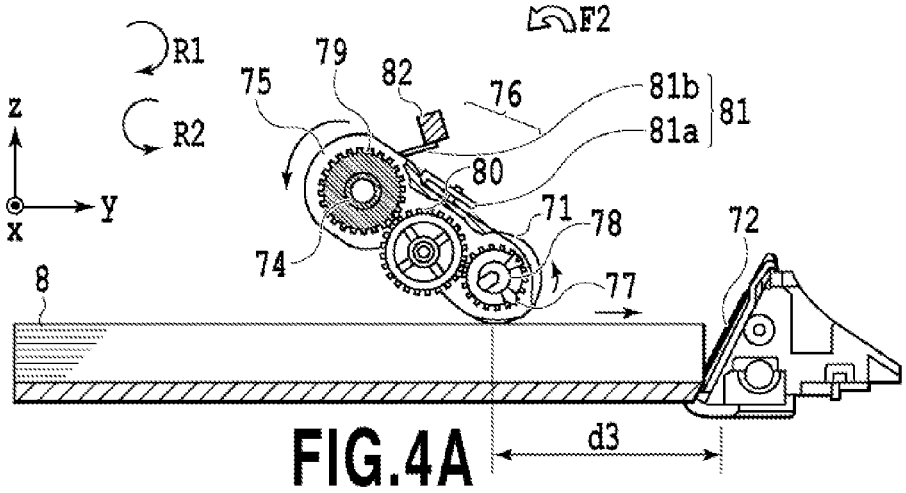
FIG. 4A is a diagram showing a supply apparatus according to a second embodiment.
Figure 4B:
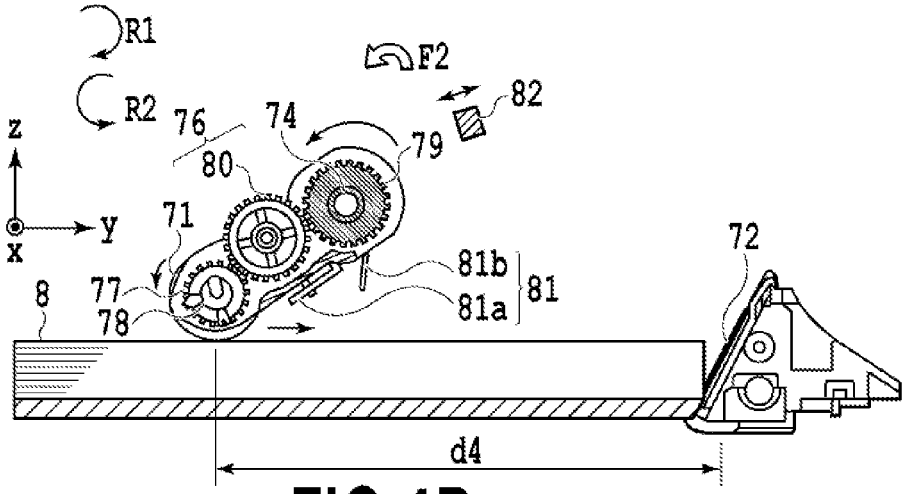
FIG. 4B is a diagram showing the supply apparatus according to the second embodiment.
Figure 4C:
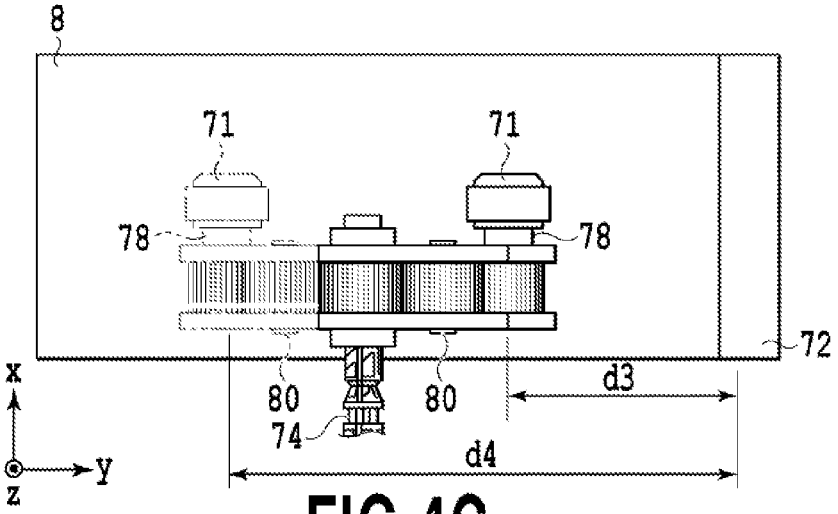
FIG. 4C is a diagram showing the supply apparatus according to the second embodiment.

FIG. 4A to FIG. 4C are diagrams each showing a supply apparatus 1 in the present embodiment. FIG. 4A is a sectional diagram showing the supply apparatus 1 in a first supply position, FIG. 4B is a sectional diagram showing the supply apparatus 1 in a second supply position, and FIG. 4C is a top diagram showing the supply apparatus 1 as viewed from a +z direction side.

As shown in FIG. 4A to FIG. 4C, a drive transmission unit 76 is provided with an idler gear 80. In this way, in the present embodiment, since the single idler gear 80 is disposed between a drive shaft 74 and a supply roller 71, the rotating direction of the drive shaft 74 is the same as the rotating direction of the supply roller 71.

In addition, in the present embodiment, one end 81*a* of the spring 81 is attached on an arm 75, and the other end 81*b* is engaged to a lock member 82. In the present embodiment, a torsion coil spring is used as the spring 81. The lock member 82 is supported by a support member (not shown). In more detail, the lock member 82 is movably supported by the support member between an engagement position to the spring 81 and a release position of releasing the engagement to the spring 81. The movement of the lock member 82 is performed by a member drive unit (not shown) that drives the support member. In the present embodiment, a shaft drive unit and the member drive unit act as a position switching unit 70.

In addition, as shown in FIG. 4A to FIG. 4C, also in the present embodiment, a distance from a first contacting position to a separation inclined surface is different from a distance from a second contacting position to the separation inclined surface. In more detail, a distance d4 from the second contacting position to the separation inclined surface 72 is longer than a distance d3 from the first contacting position to the separation inclined surface 72. With this configuration, the resistance force that the front end of the print medium receives from the separation inclined surface is adjusted also in the present embodiment.

When the drive shaft 74 rotates in an R2 direction, force F2 of rotating the arm 75 in the R2 direction is added also to the arm 75. Therefore the arm 75 is likely to move in a direction where the supply roller 71 leaves the print medium 8. In the first contacting position shown in FIG. 4A, the spring 81 is engaged to the lock member 82. At this time, the spring 81 presses the arm 75 in an R1 direction with a force stronger than a force with which the arm 75 is likely to move in the direction where the supply roller 71 leaves the print medium 8 with rotation of the drive shaft 74 in the R2 direction.

The supply roller 71 is pressed on the print medium 8 with a force that is found by subtracting a rotating force of the arm 75 by the drive shaft 74 from the pressing force of the spring 81 to transmit the conveying force to the print medium 8.

Since the pressing force of the supply roller 71 to the print medium 8 at this time is not more than the pressing force of the spring 81, the conveying force of the print medium 8 is not stronger than a desired conveying force. In addition, since the first contacting position is relatively close to the separation inclined surface 72, the resistance force that the front end of the print medium 8 receives from the separation inclined surface 72 becomes relatively strong. Therefore in the first contacting position, even in a case where the print medium is a thin sheet with a relatively low hardness, it is possible to prevent the print mediums from being fed out to be stacked.

Here, an explanation will be made of the switching from the first contacting position shown in FIG. 4A to the second contacting position shown in FIG. 4B. When the drive shaft 74 is rotated in the R2 direction in a state where the lock member 82 is moved from the engagement position to the spring 81 shown in FIG. 4A to the release position of releasing the engagement to the spring 81, the arm 75 is also rotated in the R2 direction following this rotation. Then, the arm 75 rotates to the second contacting position shown in FIG. 4B.

When the drive shaft 74 rotates in the R2 direction by releasing the engagement between the spring 81 and the lock member 82, force F2 in the R2 direction is also added to the arm 75. Therefore the arm 75 moves in a direction where the supply roller 71 is closer to the print medium 8. The supply roller 71 contacts the print medium 8 in the second contacting position and the supply roller 71 is pressed on the print medium 8 to transmit the conveying force to the print medium 8.

As shown in FIG. 4B, in the second contacting position, the spring 81 is not engaged to the lock member 82 and the pressing force of the spring 81 does not act on the arm 75. Therefore the conveying force of the print medium 8 is not affected. In addition, since the second contacting position is relatively far from the separation inclined surface 72, the resistance force that the front end of the print medium 8 receives from the separation inclined surface 72 becomes relatively weak. Therefore in the second contacting position, even in a case where the print medium is a thick sheet with a relatively strong hardness, it is possible to prevent the print medium from being not fed out.

Here, an explanation will be made of the switching from the second contacting position shown in FIG. 4B to the first contacting position shown in FIG. 4A. In a state shown in FIG. 4B, the drive shaft 74 is rotated in the R1 direction to rotate the arm 75 to the position shown in FIG. 4A. At this point the lock member 82 is moved to the engagement position to engage the spring 81. In this way, the position of the supply roller 71 in the arm 75 is switched from the second contacting position to the first contacting position.

As shown in FIG. 4A to FIG. 4C, in the present embodiment, one supply roller 71 only is provided and the supply roller 71 only contacts the print medium. Therefore the load due to contact of the other roller on the print medium is not given to the print medium. Accordingly it is possible to prevent generation of creases or breaks on the print medium.

As shown in FIG. 4C, the supply roller 71 is arranged in the same position in the x direction in any of the first contacting position and the second contacting position to supply the print medium. With this, the oblique movement of the print medium can be prevented.

In this way, in the present embodiment, the contacting position is switched by changing the rotating direction of the drive shaft 74 and the position of the lock member 82 as needed. That is, the shaft drive unit rotates the drive shaft 74 in the rotating direction in response to a command from the control unit 9 and the member drive unit moves the lock member 82 in a position (engagement position or release position) in response to a command from the control unit 9 to switch the contacting position.

In addition, in the configuration of the present embodiment, the numbers of the supply roller, the supply roller gear, the supply shaft, the idler shaft and the like can be eliminated. As a result, the present embodiment can achieve the effect similar to that of the first embodiment with the configuration in which the supply roller or the drive transmission unit is simpler than in the first embodiment.

It should be noted that in the present embodiment, the explanation is made of the configuration that the spring 81 and the lock member 82 are used to switch the contacting position. That is, the configuration that the extending direction of the arm 75 is changed to the upstream side or the downstream side in the y direction to switch the contacting position between the roller 71 supported on the end of the arm 75 and the print medium 8 is explained. However, on a condition that the extending direction of the arm 75 can be changed to the upstream side or the downstream side in the y direction, the other unit may be used without being limited to the unit by a combination of the spring and the lock member.

Third Embodiment

In the present embodiment, two arms are used, and a different number of idler gears and supply rollers are supported to each of the arms. In addition, in the present embodiment, an engagement portion is provided on each arm, and an arm lock lever engaging to the engagement portions is provided in a position between the two arms. The other configuration is the same as that of the first embodiment, and therefore the explanation will be omitted.

Figure 5A:
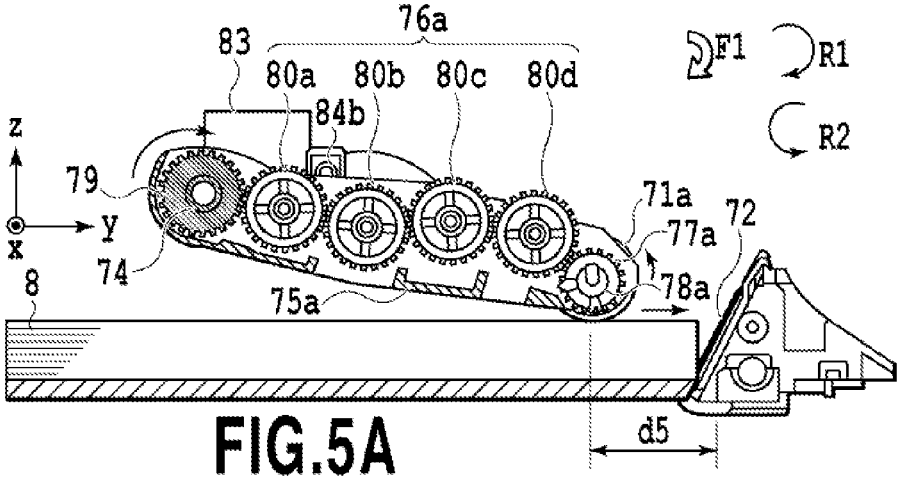
FIG. 5A is a diagram showing a supply apparatus according to a third embodiment.
Figure 5B:
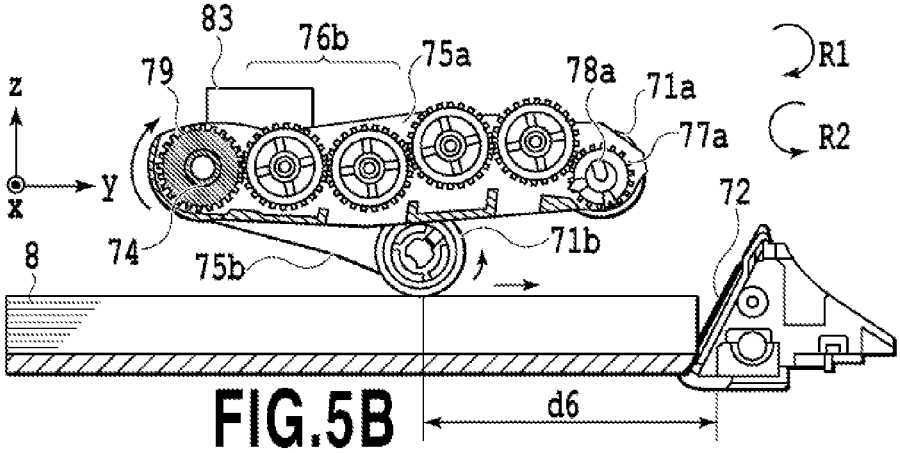
FIG. 5B is a diagram showing the supply apparatus according to the third embodiment.
Figure 5C:
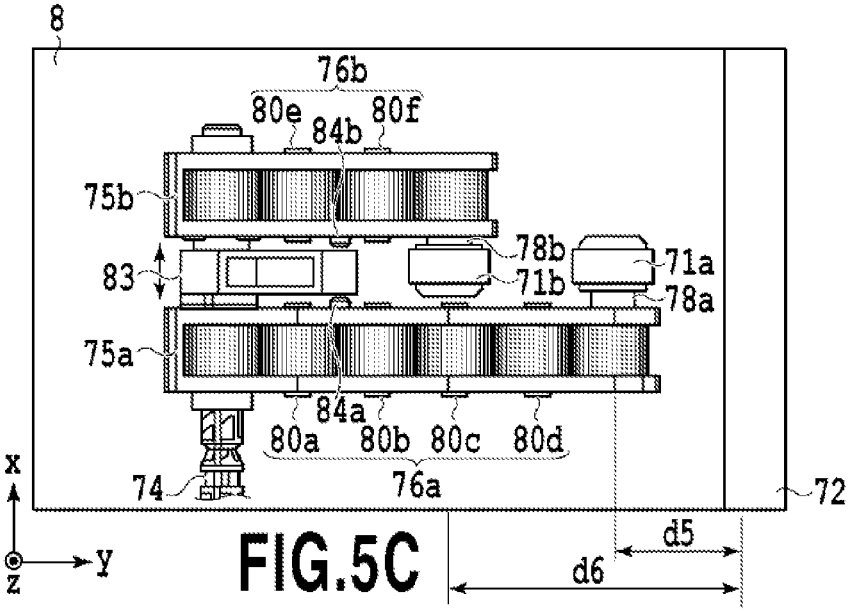
FIG. 5C is a diagram showing the supply apparatus according to the third embodiment.

FIG. 5A to FIG. 5C are diagrams each showing a supply apparatus 1 in the present embodiment. FIG. 5A is a sectional diagram showing the supply apparatus 1 in a first supply position, FIG. 5B is a sectional diagram showing the supply apparatus 1 in a second supply position, and FIG. 5C is a top diagram showing the supply apparatus 1 as viewed from a +z direction side.

As shown in FIG. 5A to FIG. 5C, in the present embodiment, arms 75*a*, 75*b* are rotatably supported on a drive shaft 74, and an end of each of the arms 75*a*, 75*b* in the upstream side in the y direction is supported on the drive shaft 74. A supply roller 71*a* is rotatably supported on an end of the arm 75*a* in the downstream side in the y direction, and a supply roller 71*b* is rotatably supported on an end of the arm 75*b* in the downstream side in the y direction.

A drive transmission unit 76*a* is provided between the drive shaft 74 and the supply roller 71*a*, and a drive transmission unit 76*b* is provided between the drive shaft 74 and the supply roller 71*b*. The drive transmission unit 76*a* is provided with idler gears 80*a* to 80*d*, and the drive transmission unit 76*b* is provided with idler gears 80*e*, 80*f*.

In addition, the arm 75*a* and the arm 75*b* are supported on the drive shaft 74 to be in parallel to each other. An arm lock lever 83 is provided between the arm 75*a* and the arm 75*b* to be supported by the drive shaft 74 to be movable in a direction of being closer to the arm 75*a* or the arm 75*b*. The arm 75*a* and the arm 75*b* are respectively provided with an engagement portion 84*a* and an engagement portion 84*b* that are engaged to the arm lock lever 83. The movement of the arm lock lever 83 is performed by a lever drive unit (not shown). In the present embodiment, a shaft drive unit and the lever drive unit act as a position switching unit 70.

As shown in FIG. 5A to FIG. 5C, also in the present embodiment, a distance from a first contacting position to a separation inclined surface is different from a distance from a second contacting position to the separation inclined surface. In more detail, a distance d6 from the supply roller 71*b* in the second contacting position to the separation inclined surface 72 is longer than a distance d5 from the supply roller 71*a* in the first contacting position to the separation inclined surface 72. With this configuration, the resistance force that the front end of the print medium receives from the separation inclined surface is adjusted also in the present embodiment.

In the present embodiment, the drive shaft 74 is first rotated in an R2 direction at the time of switching the contacting position. The arm 75*a* and the arm 75*b* are rotated in the R2 direction with rotation of the drive shaft 74, and the supply rollers 71*a*, 71*b* are separated from the print medium 8 following this rotation. In a position where the rotation of each of the arms 75*a*, 75*b* stops in contact to a stopper (not shown), the arm lock lever 83 is moved in a direction of being closer to any of the arm 75*a* or the arm 75*b* by the lever drive unit.

The arm lock lever 83 is engaged to the engagement portion of the arm that supports a supply roller not used for supply in a position where this supply roller is separated from the print medium, thus fixing the position of the arm to limit the movement of the arm. Next, when the drive shaft 74 is rotated in the R1 direction, force F1 is added to both of the arms 75*a*, 75*b*, but only the arm that is not locked by the arm lock lever 83 is rotated in the R1 direction, and only the supply roller that is supported by this arm is pressed on the print medium 8.

For example, in a case of supplying the print medium 8 in the first supply position, the arm lock lever 83 moves in a direction of being closer to the arm 75*b* to be engaged to the engagement portion 84*b* of the arm 75*b*. Next, when the drive shaft 74 is rotated in the R1 direction, since the arm 75*b* is locked in the arm lock lever 83, only the arm 75*a* rotates in the R1 direction, and only the supply roller 71*a* is pressed on the print medium 8. As a result, the state of the supply apparatus 1 is as shown in FIG. 5A.

For example, in a case of supplying the print medium 8 in the second supply position, the arm lock lever 83 moves in a direction of being closer to the arm 75*a* to be engaged to the engagement portion 84*a* of the arm 75*a*. Next, when the drive shaft 74 is rotated in the R1 direction, since the arm 75*a* is locked in the arm lock lever 83, only the arm 75*b* rotates in the R1 direction, and only the supply roller 71*b* is pressed on the print medium 8. As a result, the state of the supply apparatus 1 is as shown in FIG. 5B.

In the present embodiment, since any of the drive transmission units 76*a*, 76*b* is provided with an even number of idler gears, the rotating direction of the drive shaft 74 is different from that of the supply rollers 71*a*, 71*b*. When the drive shaft 74 is rotated in the R1 direction, the supply rollers 71*a*, 71*b* rotate in the R2 direction. Since force F1 for rotating the arms 75*a*, 75*b* in the R1 direction is added to the arms 75*a*, 75*b* at this time, only the supply roller supported to the arm not locked by the arm lock lever 83 is pressed on the print medium 8 to apply the conveying force to the print medium 8.

As shown in FIG. 5A and FIG. 5B, since any one of the two supply rollers contacts the print medium also in the present embodiment, it is possible to prevent generation of creases and the like in the print medium.

As shown in FIG. 5C, in the present embodiment, the two supply rollers are supported on the opposing surfaces of the respective arms to each other such that they are arranged in the same position in the x direction (herein, central part in the x direction). Specifically in the arm 75*a*, the supply roller 71*a* is supported on the opposing surface to the arm 75*b* in the end side of the downstream side in the y direction, and in the arm 75*b*, the supply roller 71*b* is supported on the opposing surface to the arm 75*a* in the end side of the downstream side in the y direction.

Also in a case of using the two arms each provided with the supply roller as in the present embodiment, the supply rollers arranged in the same position in the x direction each are alternatively used. By doing so, the oblique movement of the print medium can be prevented.

In this way, in the present embodiment, the contacting position is switched by changing the rotating direction of the drive shaft 74 and the position of the arm lock member 83 as needed. That is, the shaft drive unit rotates the drive shaft 74 in the rotating direction in response to a command from the control unit 9. The lever drive unit moves the arm lock lever 83 to a position (any one of the engagement position to the engagement portion 84*a*, the engagement position to the engagement portion 84*b*, and the position of releasing the engagement) in response to a command from the control unit 9. Thereby the contacting position is switched.

In addition, in the present embodiment the extending directions of the two arms are made in the same direction, and a difference of the distance between the supply roller in the first supply position and the separation inclined surface and the distance between the supply roller in the second supply position and the separation inclined surface is made smaller than in the first embodiment. This configuration can adjust the balance between the feeding-out force of the print medium by the supply roller and the resistance force of the separation inclined surface to the front end of the print medium with more accuracy as compared to the configuration in the first embodiment.

It should be noted that in the present embodiment, the explanation is made of the configuration that the arm lock lever is used to hold the supply roller not used for supply to be separated from the print medium, but a component except the arm lock lever may be used if the component achieves the effect similar to that of the present embodiment.

Fourth Embodiment

The present embodiment uses an arm that is provided with a switching arm and a support arm. One end of the support arm is rotatably supported by a drive shaft, and the switching arm is rotatably supported by an end of the support arm that is different from the one end of the support arm supported by the drive shaft. In the present embodiment, the switching arm rotatably supports the supply roller. The other configuration is the same as that of the first embodiment, and therefore the explanation will be omitted.

Figure 6A:
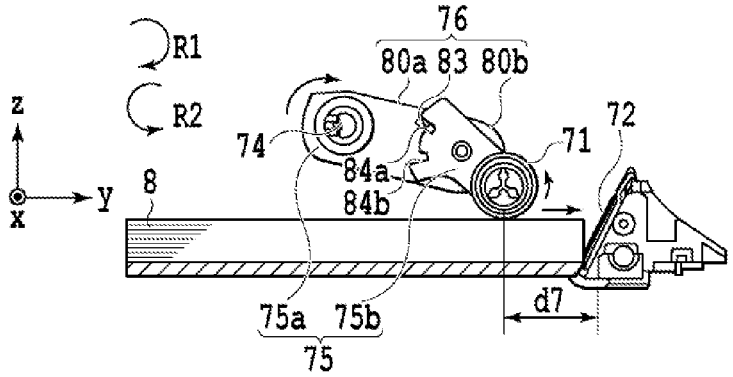
FIG. 6A is a diagram showing a supply apparatus according to a fourth embodiment.
Figure 6B:
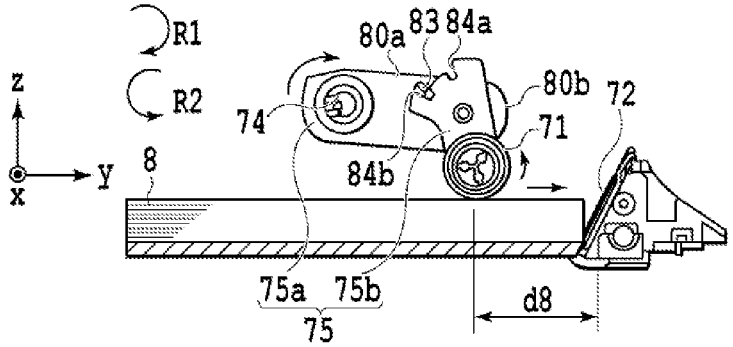
FIG. 6B is a diagram showing the supply apparatus according to the fourth embodiment.
Figure 6C:
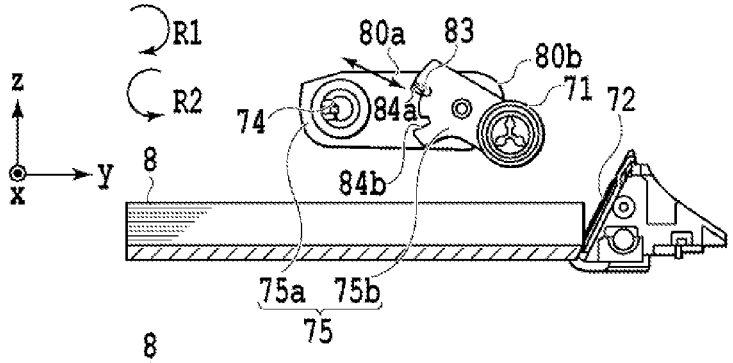
FIG. 6C is a diagram showing the supply apparatus according to the fourth embodiment.
Figure 6D:
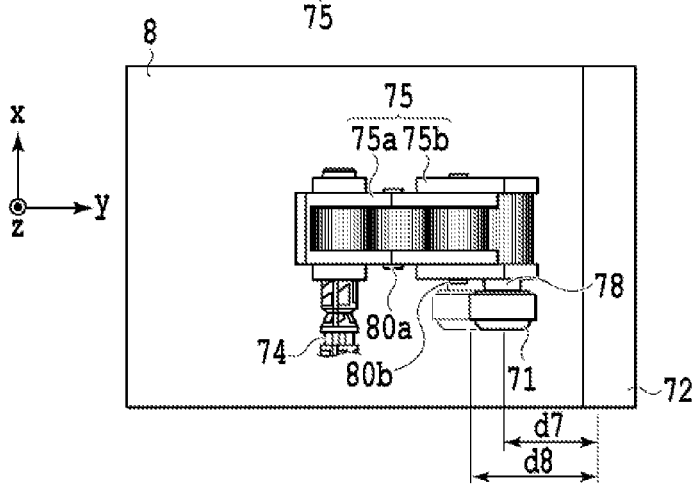
FIG. 6D is a diagram showing the supply apparatus according to the fourth embodiment.

FIG. 6A to FIG. 6D are diagrams each showing a supply apparatus 1 in the present embodiment. FIG. 6A is a sectional diagram showing the supply apparatus 1 in a first supply position, FIG. 6B is a sectional diagram showing the supply apparatus 1 in a second supply position, FIG. 6C is a sectional diagram showing the switching of the supply position, and FIG. 6D is a top diagram showing the supply apparatus 1 as viewed from a +z direction side.

As shown in FIG. 6A to FIG. 6D, in the present embodiment an arm 75 includes a support arm 75*a* and a switching arm 75*b*. The support arm 75*a* is rotatably supported by a drive shaft 74. The support arm 75*a* supports a drive transmission unit 76 and the switching arm 75*b*.

The drive transmission unit 76 is provided with idler gears 80*a*, 80*b*. The switching arm 75*b* is rotatable around a shaft of the idler gear 80*b*, and rotatably supports a supply roller 71. The switching arm 75*b* is provided with engagement portions 84*a*, 84*b*. The support arm 75*a* is provided with an arm lock lever 83, which is engaged to the engagement portion 84*a* or the engagement portion 84*b*. The arm lock lever 83 moves between an engagement position engaging to the engagement portion and a release position of releasing the engagement to the engagement portion. This movement is performed by the drive unit (not shown).

In the present embodiment, the drive shaft 74 is first rotated in an R2 direction at the time of switching the supply position. With rotation of the drive shaft 74, the support arm 75*a* is rotated in the R2 direction and the supply roller 71 is separated from the print medium 8. In a position (position shown in FIG. 6C) where the rotation of the support arm 75*a* stops in contact to a stopper (not shown), the arm lock lever 83 is moved in a release position of releasing the engagement. The subsequent operations will be explained individually since it differs depending on which supply position to be selected.

In a case of supplying the print medium 8 in the first supply position, the drive shaft 74 is rotated in the R2 direction. The switching arm 75*b* rotates in the R2 direction with rotation of the idler gear 80*b*. The switching arm 75*b* is rotated to a position where the engagement portion 84*a* is engaged to the arm lock lever 83 to move the arm lock lever 83 to the engagement position. In addition, the engagement portion 84*a* is made to be engaged to the arm lock lever 83 to lock the switching arm 75*b*. When the drive shaft 74 is rotated in the R1 direction in this state, the support arm 75*a* rotates in the R1 direction, and the supply roller 71 is pressed on the print medium 8, a state of which is illustrated as shown in FIG. 6A.

In a case of supplying the print medium 8 in the second supply position, the drive shaft 74 is rotated in the R1 direction. The switching arm 75*b* rotates in the R1 direction with rotation of the idler gear 80*b*. The switching arm 75*b* is rotated to a position where the engagement portion 84*b* is engaged to the arm lock lever 83 to move the arm lock lever 83 to the engagement position. In addition, the engagement portion 84*b* is made to be engaged to the arm lock lever 83 to lock the switching arm 75*b*. When the drive shaft 74 is rotated in the R1 direction in this state, the support arm 75*a* rotates in the R1 direction, and the supply roller 71 is pressed on the print medium 8, a state of which is illustrated as shown in FIG. 6B.

In any case, the rotating direction of the drive shaft 74 is different from the rotating direction of the supply roller 71. When the drive shaft 74 rotates in the R1 direction, the supply roller 71 rotates in the R2 direction. Since force F1 in the R1 direction is added to the support arm 75*a* at this time, the supply roller 71 is pressed on the print medium 8 to transmit the conveying force to the print medium 8.

As shown in FIG. 6A and FIG. 6B, since one supply roller is used in the present embodiment, the supply roller to which rotation from the drive shaft is not transmitted does not contact on the print medium together with the supply roller to which the rotation from the drive shaft is transmitted. Therefore it is possible to prevent the print medium from being broken or generation of creases thereon.

As shown in FIG. 6A, FIG. 6B and FIG. 6D, also in the present embodiment, a distance from a first contacting position to a separation inclined surface is different from a distance from a second contacting position to the separation inclined surface. In more detail, a distance d8 from the second contacting position to the separation inclined surface is longer than a distance d7 from the first contacting position to the separation inclined surface. With this configuration, the resistance force that the front end of the print medium receives from the separation inclined surface is adjusted also in the present embodiment.

In addition, in the present embodiment the extending directions of the arms are made in one direction, and thereby a difference of the distance between the supply roller in the first supply position and the separation inclined surface and the distance between the supply roller in the second supply position and the separation inclined surface is made smaller than in the first embodiment. Further, in the present embodiment, the arm provided with the support arm and the switching arm is used to switch the contacting position at a position midway of the extending direction of the arm. This configuration allows the balance between the feeding-out force of the print medium by the supply roller and the resistance force of the separation inclined surface to the front end of the print medium to be adjusted with more accuracy.

As shown in FIG. 6D, also in the present embodiment, the supply roller is arranged in the same position in the x direction in any of the first contacting position and the second contacting position. This configuration can prevent the oblique movement of the print medium 8 also in the present embodiment.

In this way, in the present embodiment, the contacting position is switched by changing the rotating direction of the drive shaft 74 and the position of the arm lock member 83 as needed. That is, the shaft drive unit rotates the drive shaft 74 in the rotating direction in response to a command from the control unit 9. The drive unit moves the arm lock lever 83 to a position (engagement position or release position) in response to a command from the control unit 9. The contacting position is thereby switched.

It should be noted that in the present embodiment the explanation is made of the configuration that the two engagement portions are provided to switch the contacting position. However, there may be provided three or more engagement portions to switch the contacting position to three or more positions. This configuration allows the balance between the conveying force of the print medium by the supply roller and the resistance force of the separation inclined surface to the front end of the print medium to be adjusted with more accuracy.

In the present embodiment, the method for using the arm lock lever 83 and the switching arm 75*b* is explained as the method for changing the extending direction of the arm 75. However, a component other than the arm lock lever and the switching arm may be used as long as the component can switch the extending direction of the arm.

Other Embodiments

In the above-mentioned embodiments, the configuration in which the drive transmission unit is provided with the idler gear that transmits the rotation of the drive shaft to the supply shaft is explained. However, the drive transmission unit is not limited to the configuration in which the idler gear is provided as long as the rotation of the drive shaft can be transmitted to the supply roller. For example, a belt or chain may be used as the drive transmission unit.

In addition, in the above-mentioned embodiments, the configuration in which the arm rotates around the drive shaft is explained. However, the arm may rotate around a predetermined axis.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment (s) and/or that includes one or more circuits (e.g., application specific integrated circuit (ASIC)) for performing the functions of one or more of the above-described embodiment (s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment (s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-260503, filed Dec. 17, 2013, which is hereby incorporated by reference wherein in its entirety.

What is claimed is:

1. A supply apparatus comprising:

a first supply member that contacts a print medium at a first position and feeds out the print medium;

a second supply member that contacts the print medium at a second position located upstream of the first position in the feeding-out direction and feeds out the print medium;

a drive transmission unit configured to transmit rotation of a drive shaft to the first supply member and the second supply member;

an arm member that supports the first supply member, the second supply member and the drive transmission unit and rotates around a predetermined axis, and a control unit that switches contacting state between a first contacting state in which the first supplying member contacts with the printing medium and the second supplying member does not contact with the printing medium and a second contacting state in which the first supplying member does not contact with the printing medium and the second supplying member contacts with the printing medium.

2. The supply apparatus according to claim 1, wherein the first position and the second position are located on a single line leading in the feeding-out direction.

3. The supply apparatus according to claim 2, wherein the single line is located at a central part of the print medium in the crossing direction.

4. The supply apparatus according to claim 1, wherein the arm member supports the first supply member on one end side thereof and the second supply member on an other end side.

5. The supply apparatus according to claim 1, wherein the drive transmission unit includes a first drive transmission unit that transmits rotation of the drive shaft to the first supply member, and a second drive transmission unit, different from the first drive transmission unit, that transmits rotation of the drive shaft to the second supply member, the first supply member and the first drive transmission unit are arranged at a downstream side position, and the second supply member and the second drive transmission unit are arranged at an upstream side position.

6. The supply apparatus according to claim 1, wherein the first contacting state and the second contacting state are switched by changing a rotating direction of the drive shaft.

7. The supply apparatus according to claim 1, wherein the arm member includes a support arm and a switching arm, the support arm supports the drive transmission unit, rotates around the predetermined axis, and includes a support portion, the switching arm supports the supply member, rotates around a shaft of the drive transmission unit, and includes at least two engagement portions, wherein a contacting position is switched by engagement of any of the at least two engagement portions to the support portion.

8. The supply apparatus according to claim 1, further comprising:

a separation inclined surface that separates the print medium fed out by the supply member, wherein the control unit switches the contacting state between the first contacting state and the second contacting state based upon a distance from a contacting position to the separation inclined surface.

9. The supply apparatus according to claim 1, further comprising an information obtaining unit that obtains at least one of information regarding a kind of the print medium, information regarding a print process executed to the print medium, information regarding an environment, information regarding the number of the supplied print mediums, and information regarding a feeding-out condition of the print medium, wherein the control unit switches the contacting state based upon the information that is obtained by the information obtaining unit.

10. The supply apparatus according to claim 1, further comprising:

an information obtaining unit that obtains information regarding a time from a point where supply of the print medium starts to a point where the print medium reaches a supply position is obtained, wherein the control unit switches the contacting state based upon the obtained information that is obtained by the information obtaining unit.

11. The supply apparatus according to claim 1, wherein the rotation of the drive shaft is used by the control unit both for driving the first supply member and the second supply member and for changing the contacting state.

12. A method for supplying a print medium in a supply apparatus including a first supply member that contacts a print medium at a first position and feeds out the print medium, a second supply member that contacts the print medium at a second position located upstream of the first position in the feeding-out direction and feeds out the print medium; a drive transmission unit configured to transmit rotation of a drive shaft to the first supply member and the second supply member, and an arm member that supports the first supply member, the second supply member and the drive transmission unit and rotates around a predetermined axis, comprising the step of:

switching, by a control unit, a contacting state between a first contacting state in which the first supplying member contacts with the printing medium and the second supplying member does not contact with the printing medium and a second contacting state in which the first supplying member does not contact with the printing medium and the second supplying member contacts with the printing medium.

13. The method for supplying a print medium according to claim 12, further comprising the step of:

classifying the print medium into a first kind and a second kind, wherein the first contacting state is realized at the time of supplying the first kind of the print medium and the second contacting state is realized at the time of supplying the second kind of the print medium.

14. A supply apparatus comprising:

a first supply member that contacts a print medium and feeds out the print medium;

a second supply member that contacts the print medium and feeds out the print medium;

a support member that supports the first supply member and the second supply member;

a separation inclined surface that applies a resistance on a front end of the print medium fed out by the first supply member or the second supply member; and a control unit that switches a contacting state between a first contacting state in which the first supplying member contacts with the printing medium at a first position and the second supplying member does not contact with the printing medium and a second contacting state in which the first supplying member does not contact with the printing medium and the second supplying member contacts with the printing medium at a second position that is farther away than the first position in a distance from the separation inclined surface.

15. The supply apparatus according to claim 14, wherein the first position and the second position are located on a single line leading in the feeding-out direction.

16. The supply apparatus according to claim 15, wherein the single line is located at a central part of the print medium in the crossing direction.

17. The supply apparatus according to claim 14, wherein the support member supports the first supply member on one end side thereof and the second supply member on an other end side.

18. The supply apparatus according to claim 14, wherein the support member includes an engagement portion that is engaged to a regulation member for limiting movement of the support member, the regulation member is movable to a position of engaging to the engagement portion and a position of releasing the engagement to the engagement portion, wherein a distance changing unit changes the distance to the position where the supply member contacts print medium based upon whether or not the engagement portion and the regulation member are engaged.

19. A printing apparatus comprising:

a first supply member that contacts a print medium at a first position and feeds out the print medium;

a second supply member that contacts the print medium at a second position located upstream of the first position in the feeding-out direction and feeds out the print medium;

a drive transmission unit configured to transmit rotation of a drive shaft to the first supply member and the second supply member;

an arm member that supports the first supply member, the second supply member and the drive transmission unit and rotates around a predetermined axis;

a control unit that switches a contacting state between a first contacting state in which the first supplying member contacts with the printing medium and the second supplying member does not contact with the printing medium and a second contacting state in which the first supplying member does not contact with the printing medium and the second supplying member contacts with the printing medium; and a printing unit that performs a print on the print medium supplied from the supply apparatus.

20. A supply apparatus comprising:

a supply member that contacts a print medium and feeds out the print medium;

a support member that supports the supply member;

a separation inclined surface that applies a resistance to a front end of the print medium fed out by the supply member; and a control unit that switches a contacting state between a first contacting state in which the supplying member contacts with the printing medium at a predetermined position and a second contacting state in which the supplying member contacts with the printing medium at a position further from the separation inclined surface than the predetermined position by changing a rotating direction of a drive shaft.

21. A supply apparatus comprising:

a supply member that contacts a print medium and feeds out the print medium;

a drive transmission unit configured to transmit rotation of a drive shaft to the supply member;

an arm member that supports the supply member and the drive transmission unit and rotates around a predetermined axis, and a control unit that switches a contacting state between a first contacting state in which the supplying member contacts with the printing medium at a predetermined position and a second contacting state in which the supplying member contacts with the printing medium upstream of the predetermined position in the feeding-out direction by changing a rotating direction of the drive shaft.

22. The supply apparatus according to claim 21, wherein the arm member includes an engagement portion that is engaged to a regulation member for limiting movement of the arm member, the regulation member is movable to a position of engaging to the engagement portion and a position of releasing the engagement to the engagement portion, wherein the contacting position is switched based upon whether or not the engagement portion and the regulation member are engaged.

23. The supply apparatus according to claim 22, wherein the arm member includes a first arm member and a second arm member, the first arm member includes a first engagement portion and the second arm member includes a second engagement portion, wherein the contacting position is switched by engagement of any of the first engagement portion or the second engagement portion to the regulation member.

* * * * *